US005402657A

United States Patent [19]

Henry, Jr.

[11] Patent Number: 5,402,657

[45] Date of Patent: Apr. 4, 1995

[54] DEVICE FOR REMOVING STAINS FROM FABRIC

[75] Inventor: Richard A. Henry, Jr., Longview, Tex.

[73] Assignee: Technical Advantage, Longview, Tex.

[21] Appl. No.: 100,286

[22] Filed: Aug. 2, 1993

[51] Int. Cl.[6] ..... D06B 5/22

[52] U.S. Cl. ..... 68/5 A; 68/205 R; 68/200; 68/240

[58] Field of Search ..... 68/222, 6, 5 R, 5 A, 68/200, 205 R, 240, 20; 210/409, 412, 413, 415; 239/103, 120, 122; 8/148; 118/323, 326; 134/155, 88, 167 R, 168 R, 180, 181, 176, 179, 183, 192, 200, 195, 196, 197, 191, 173

[56] References Cited

U.S. PATENT DOCUMENTS

| | | | |
|---|---|---|---|
| 1,036,669 | 8/1912 | McClure | 134/195 X |
| 1,105,045 | 7/1914 | Shipherd | 134/195 X |
| 1,281,493 | 10/1918 | Blanks | 134/176 |
| 1,292,407 | 1/1919 | Spicer | 134/195 |
| 2,009,365 | 7/1935 | Wait . | |
| 2,295,718 | 9/1942 | Dahlberg . | |
| 2,810,216 | 10/1957 | Greer . | |
| 3,320,780 | 5/1967 | Frahm . | |
| 3,868,835 | 3/1975 | Todd-Reeve | 134/176 X |
| 4,120,180 | 10/1978 | Jedora . | |
| 4,811,902 | 3/1989 | Nagata | 134/181 X |
| 4,967,962 | 11/1990 | Kawaguchi et al. | 134/181 X |
| 5,074,132 | 12/1991 | Koller | 239/120 X |

FOREIGN PATENT DOCUMENTS

| | | | |
|---|---|---|---|
| 418736 | 3/1991 | European Pat. Off. | 239/103 |
| 1060830 | 7/1959 | Germany | 68/205 |
| 2019900 | 11/1971 | Germany | 68/205 R |
| 3141516 | 5/1983 | Germany | 134/167 R |
| 635512 | 3/1962 | Italy | 134/180 |
| 142117 | 11/1961 | U.S.S.R. | 134/175 |

*Primary Examiner*—Frankie L. Stinson
*Attorney, Agent, or Firm*—Herbert J. Hammond

[57] ABSTRACT

A device for removing stains from fabric is a household laundry appliance that mechanically removes stains or spots from fabric. A piston/nozzle assembly lowers from a piston housing in the device until it contacts the non-stain side of the fabric. Multiple nozzles force cleaning solution through the stained fabric at a high pressure, thereby exculpating the particles causing the stain. The cleaning solution flows through the fabric, through a screen below and into a reservoir in the hollow base of the device. The cleaning solution may be recycled for later use.

18 Claims, 5 Drawing Sheets

DEVICE FOR REMOVING STAINS FROM FABRIC

TECHNICAL FIELD

This invention relates generally to the field of devices for cleaning fabric and, more particularly to a device for mechanically removing isolated stains from fabric.

BACKGROUND OF THE INVENTION

Stains on clothing such as food, ink, grass and grease are a common side effect of normal wear. Inability to remove the stains may require the user to purchase a replacement garment with its attendant cost. In the self-service and commercial laundering and dry cleaning industries, the principal cleaning operation affects only the overall treatment of the garment or other fabric article. When there are isolated spots or stains in the fabric that are resistant to removal and do not respond to the overall treatment, the soiled or stained spots may need individual treatment. Other than treatment of the individual stain, the garment may not require overall cleaning.

Although some commercial laundries employ spotters to locate stains prior to general cleaning, self-service establishments and consumers washing clothes at home do not have an appliance designed to remove small, isolated stains only. Even for those commercial operations having spotters, the cost to the consumer for removal of small stains may be prohibitive if done on a regular basis. Therefore, there is a need for a device for removing stains from clothing at home that is inexpensive, simple and easy to use and that efficiently removes stains. The device should be portable and require no electrical or battery power for operation.

SUMMARY OF THE INVENTION

The present invention comprises a device for removing stains from fabric that overcomes the foregoing disadvantages of the prior art. The device comprises a hollow base member having an opening in the upper surface therein for a screen. A support member integrally mounted to the base member extends upwardly therefrom and has a first opening for receiving cleaning solution and a second opening for delivering cleaning solution to the stained fabric. A piston/nozzle assembly disposed within the support member includes a cylinder capable of projecting from and retracting into the second opening of the support member. A piston disposed within the cylinder projects from and retracts into the cylinder. Multiple nozzles attached to the piston deliver pressurized cleaning solution to the stained fabric. A lever fixably mounted to the support member controls movement of the piston/nozzle assembly. Transporting means conveys cleaning solution from the hollow base member to the piston/nozzle assembly.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
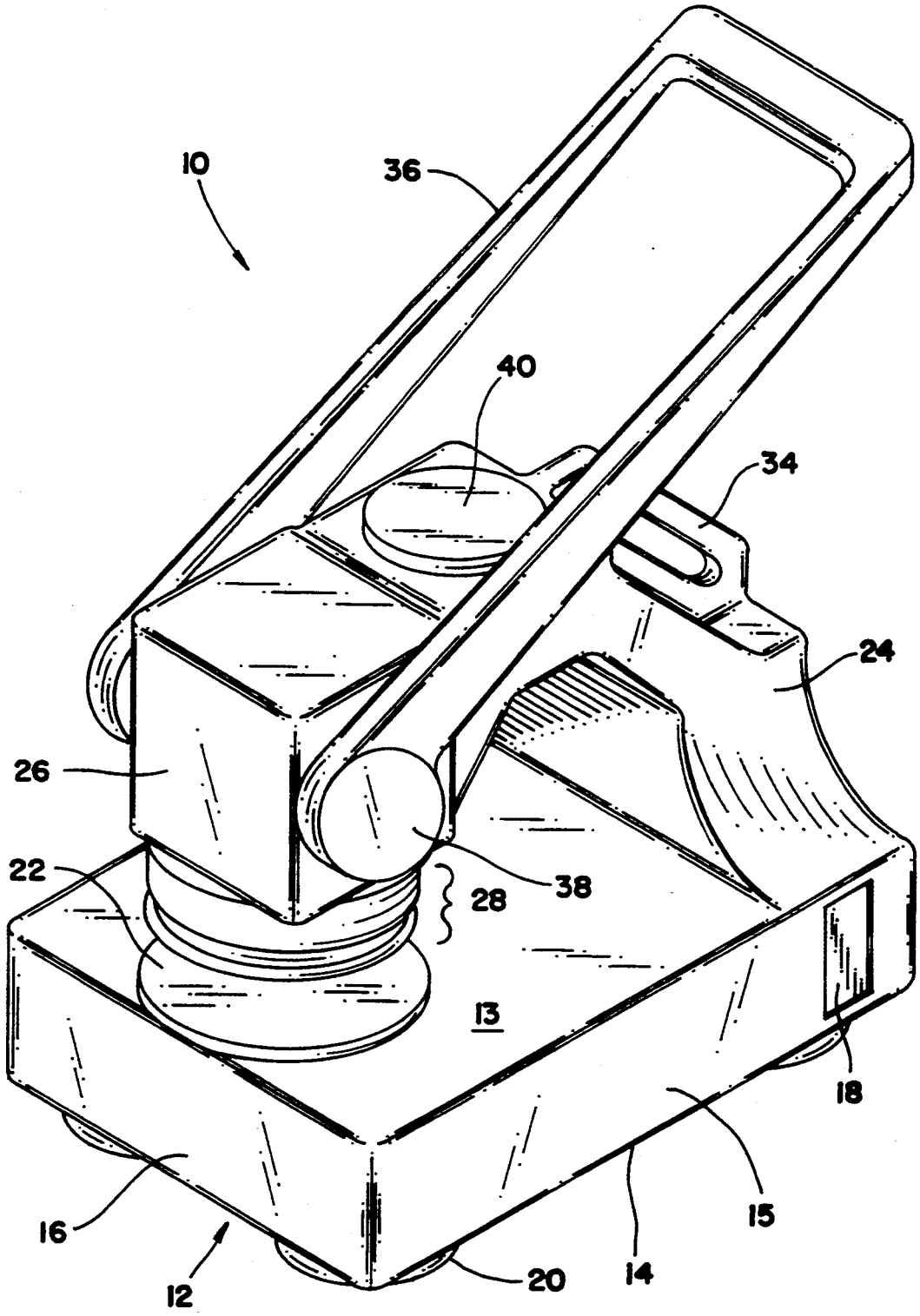
FIG. 1 is a perspective view of the preferred embodiment of the present invention.

Referring now to the Drawings wherein like reference characters designate like or similar parts throughout the seven views, FIGS. 1 and 3A–3C are perspective, top, side and end views, respectively, of the preferred embodiment of the present invention 10. In the preferred embodiment, the device 10 for removing stains from clothing is constructed of polypropylene or another commercially available plastic. The device 10 contains no electrical or battery-power components. Rather, the device operates mechanically to remove stains from fabric.

A substantially rectangular base 12 has an upper surface 13, lower surface 14, side panels 15 and end panels 16. Base 12 provides support for the device 10 during operation. The base is hollow, creating a reservoir 44 (not shown) for cleaning fluid.

Figure 4:
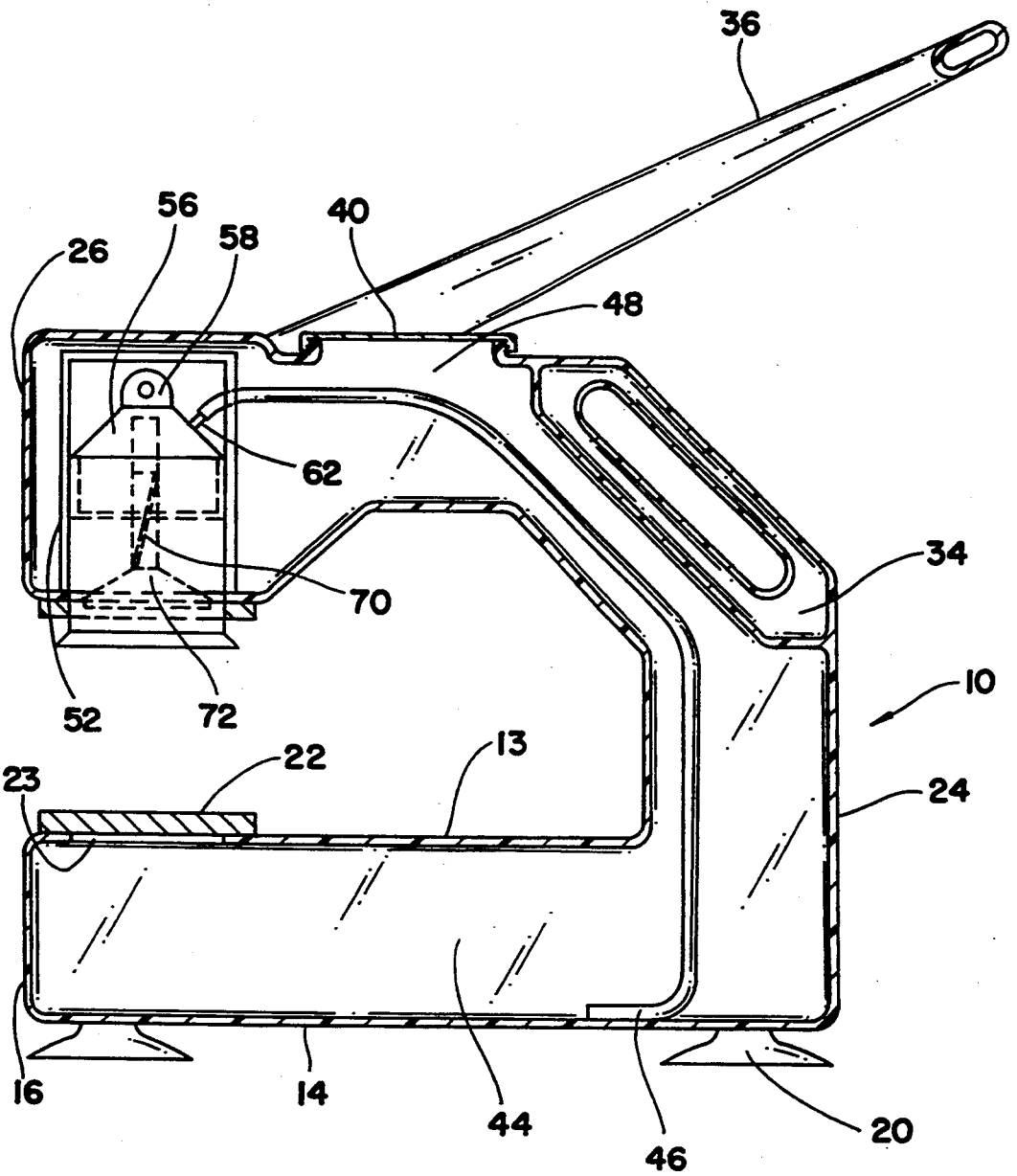
FIG. 4 is a longitudinal cross-sectional view of the device, illustrating the relationship between the reservoir and the piston/nozzle assembly.

A fluid level indicator window 18 permits the user to determine the amount of cleaning fluid in the reservoir 44 (FIG. 4). The user may also inspect the cleaning fluid for contamination via the fluid level indicator window 18. Arrows, gradations or some other means for indicating fluid volume may be included on the fluid level indicator window 18.

Suction cups 20 or another commercially known attachment means are fixably mounted on the lower surface 14 of base 12. The suction cups 20 secure the device 10 to a flat surface, such as the top of a front-loading clothes dryer. In this way, the device 10 is easily accessible for use as laundry items are placed into the washing machine. In the preferred embodiment illustrated in FIG. 1, multiple suction cups 20 are mounted to the lower surface 14 of base 12.

A screen 22 is superimposed over an opening (FIG. 4) in the upper surface 13 of base 12. Screen 22 is positioned towards the front of upper surface 13 of base 12 so that screen 22 is aligned with a piston/nozzle assembly 28. The substantially circular screen 22 is constructed of a plastic mesh or some other commercially known, filter-like material capable of withstanding the force exerted by the rotating nozzle during operation. Cleaning fluid flows through screen 22 into the reservoir 44 (FIG. 4) in base 12 and is visible through fluid level window 18.

A "goose-neck" shaped support member 24 is integrally mounted to base 12. Support member 24 extends upwardly and forwardly from the upper surface 13 of base 12 and terminates in a cylinder-shaped member 26 that houses the piston/nozzle assembly 28. The support member 24 and the piston housing 26 do not physically connect to the upper surface 13 of base 12 or to drain 23. There is a space between drain 23 and piston/nozzle assembly 28 such that a garment may be positioned therebetween.

Figure 2:
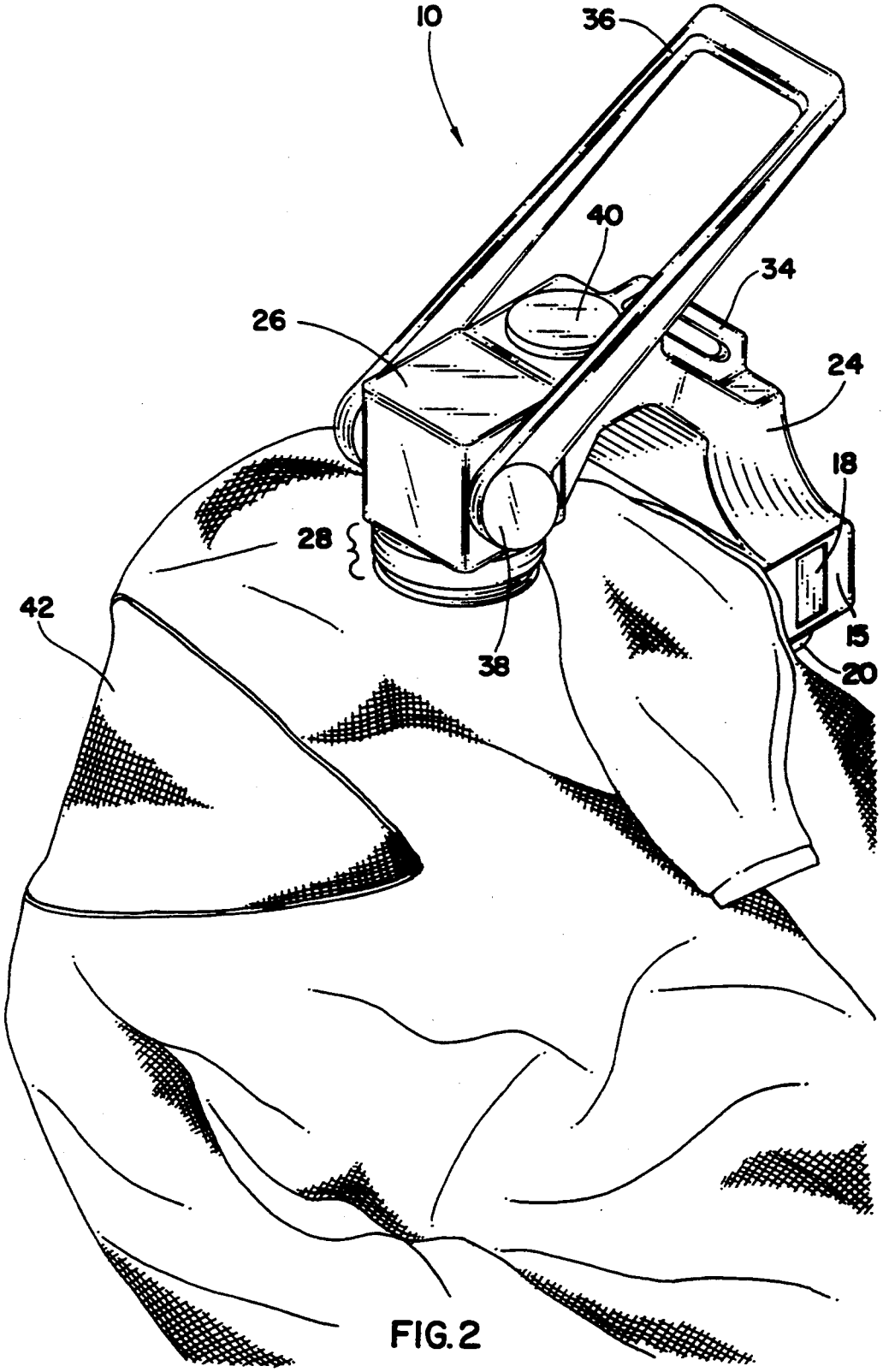
FIG. 2 is a perspective view of the device of FIG. 1 illustrating a piece of clothing in place for stain removal.

A piston/nozzle assembly 28 extends downwardly out of an opening in piston housing 26. Multiple nozzles (FIG. 5) project from the secondary cylinder (FIG. 5) of the piston/nozzle assembly 28. The nozzles force cleaning fluid under pressure through a soiled garment 42 (FIG. 2). Piston/nozzle assembly 28 is aligned with and directly above screen 22.

A handle 34 may be mounted to support member 24 to permit the device 10 to be easily lifted and transported. A lever 36 extends upwardly from the piston housing 26 towards the back of the device 10. In the preferred embodiment, lever 36 extends upwardly at approximately a forty-five (45) degree angle from piston housing 26. Knobs 38 secure lever 36 to piston housing 26.

An opening (FIG. 4) in the upper surface of support member 24 allows the user to add additional cleaning fluid to the device 10. In the alternative, the opening may be positioned elsewhere, such as on the side of the device 10. A cap 40 covers the opening, ensuring that cleaning fluid does not spill out of the device during transport. Preferably, the device uses a commercially known, screw-on, vented cap 40. Alternatively, a snap-on cap may be used.

Figure 3A:
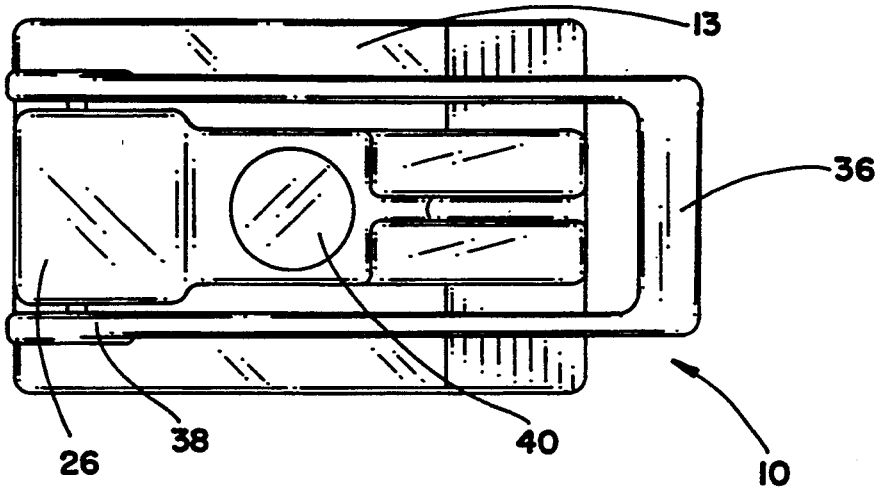
FIG. 3A is a top view of the device according to the present invention.
Figure 3B:
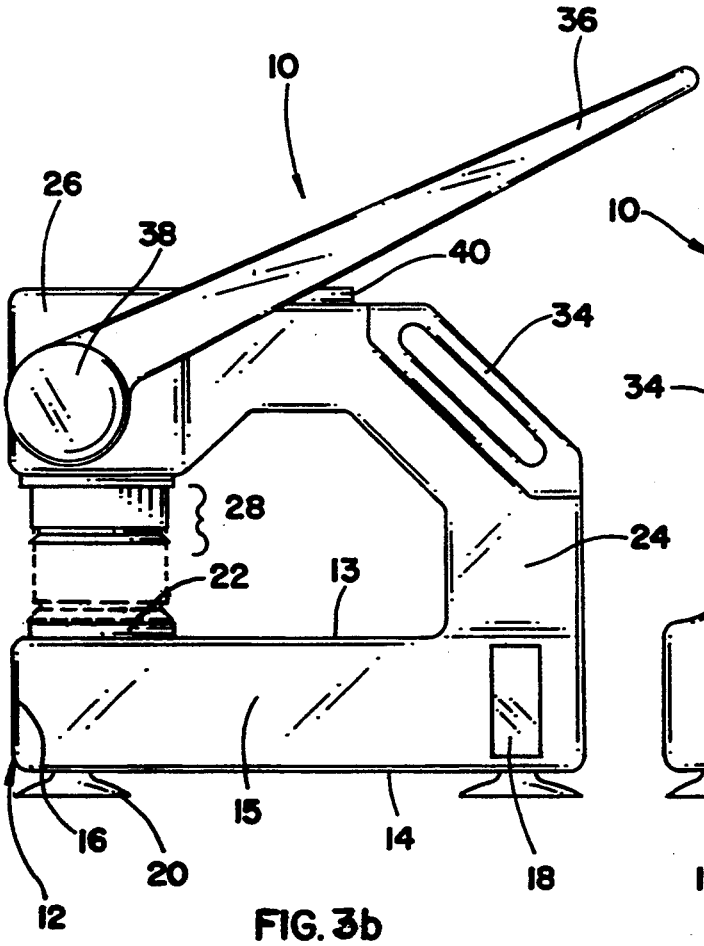
FIG. 3B is a side view of the device according to the present invention, illustrating the position of the piston/nozzle assembly during operation.
Figure 3C:
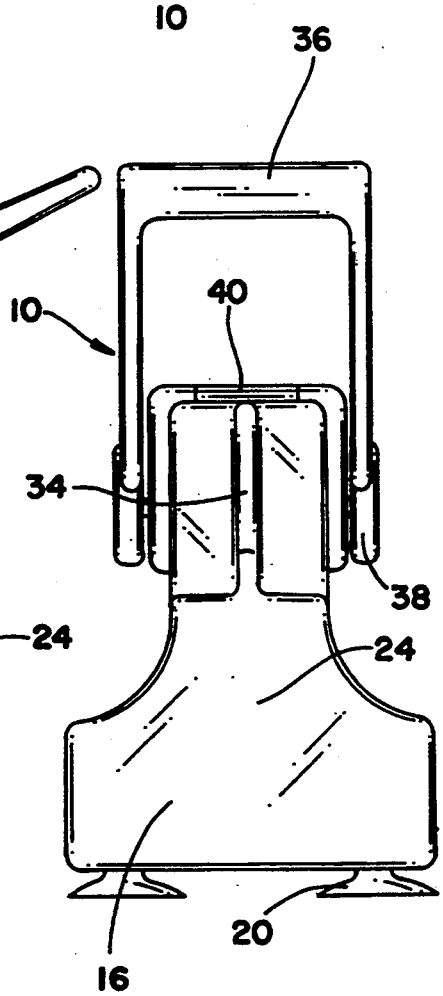
FIG. 3C is an end view of the device according to the present invention.

As illustrated in FIG. 2, a soiled garment 42 is positioned stain-side down between piston/nozzle assembly 28 and screen 22. As the user mechanically depresses lever 36, the piston/nozzle assembly 28 lowers to meet screen 22, thereby "locking" the soiled garment 42 therebetween. The dotted lines in FIG. 3B illustrate the position of piston/nozzle assembly 28 during operation of the device 10.

As the user further depresses lever 36, multiple nozzles (FIGS. 3B and 5) inside piston/nozzle assembly 28 force cleaning solution through the stained area of the garment 42. Preferably, the force applied by the nozzles to the fabric is approximately 100 pounds per square inch (100 psi). The pressure exerted by the nozzles forces the stain particles from the garment 42. After the cleaning solution containing the stain particles has passed through garment 42, the solution flows through screen 22 and returns into the reservoir 44 (FIG. 4) below. In this manner, the cleaning solution may be recycled and a uniform level of fluid is maintained in the reservoir.

Figure 5:
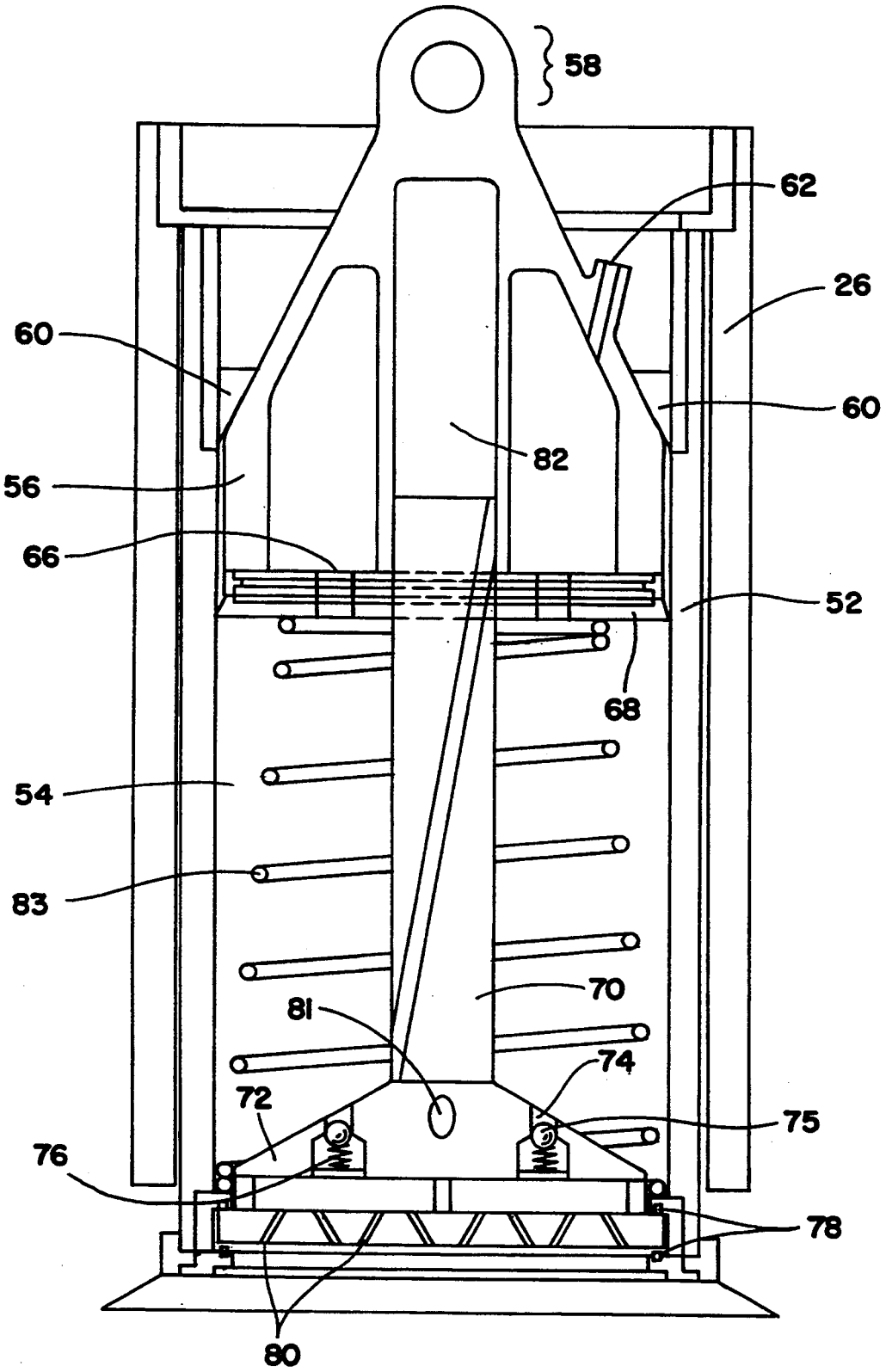
FIG. 5 is an enlarged cross-sectional view of the piston/nozzle assembly shown in FIGS. 1 and 3B.

FIG. 4 shows a longitudinal cross-section of the device for removing stains from fabric 10, illustrating the relationship between the piston/nozzle assembly 28 and the reservoir 44. Screen 22 covers drain 23 in the upper surface 13 of base 12. Cleaning solution flows through the garment 42 (FIG. 2) and through screen 22 into reservoir 44. A flexible transport tube 46 extends upwardly from reservoir 44 in base 12 into the piston/nozzle assembly 28 located in piston housing 26. Transport tube 46 conveys cleaning solution to the piston/nozzle assembly 28 for reuse and ensures that a constant supply of cleaning fluid is always available. A filter (not shown) may be attached to the end of transport tube 46 in reservoir 44. The user may remove cap 40 to add more cleaning solution through opening 48. Turning now to FIG. 5, there is shown an enlarged cross-sectional view of the components located within the piston housing or primary cylinder 26. A secondary cylinder 52 is located within piston housing 26, creating a dual-cylinder mechanism. A pressure chamber 54 within secondary cylinder 52 contains cleaning solution.

A piston 56 raises and lowers from within the secondary cylinder 52. Attachment means 58 secures the piston 56 to lever 36. The interior of piston 56 is threaded. Piston stops 60 limit upward movement of piston 56 during operation of the device.

A tube 46 nipple 62 on piston 56 receives the transport tube (FIG. 4) for conveying cleaning solution to and from the reservoir 44 (FIG. 4). Inlet check valves 66 at the base of piston 56 convey cleaning solution into pressure chamber 54. The one-way inlet check valves 66 permit cleaning fluid to flow into pressure chamber 54 but do not allow fluid flow from the chamber back into piston 56.

A piston seal 68 creates friction against the secondary cylinder 52 to permit movement of piston 56 and secondary cylinder 52. Openings in the piston seal 68 allow cleaning solution to flow from piston 56 through inlet check valves 66.

A threaded nozzle stem 70 projects from and retracts into piston 56. Nozzle stem 70 terminates in a rotating nozzle assembly 72. In the preferred embodiment, the nozzle stem 70 is hollow. There is an opening 82 in the upper portion of nozzle stem 70 and an opening 81 in the base of the nozzle stem 70. The openings 81 and 82 allow release of cleaning solution that has become entrapped in nozzle stem 70 during a pressure cycle.

Cleaning solution flows from pressure chamber 54 through outlet check valves 74 on nozzle assembly 72. Like the inlet check valves 66, the outlet check valves 74 are one-way valves. Each outlet check valve 74 includes a check ball 75 and a spring 76. When the piston 56 lowers over the nozzle stem 70, cleaning solution enters the outlet check valves 74. Check ball 75 moves downwardly towards spring 76 and allow cleaning solution to enter the nozzles 80. When the downward movement of piston 56 is halted, spring 76 forces check ball 75 back into its original position in the outlet check vane 74, preventing return of cleaning solution into the pressure chamber 54 and the piston 56.

O-rings 78 seal the contact between nozzle assembly 72 and secondary cylinder 52. A cup-style piston-to-cylinder seal or some other commercially available seal may be substituted for the O-rings. The seal created by the O-rings 78 must be loose enough to allow the nozzle assembly 72 to rotate but tight enough to prevent air intake during piston 56 retraction.

Multiple nozzles 80 located at the base of nozzle assembly 72 receive cleaning solution from pressure chamber 54 via outlet check valves 74. The nozzles may be multi-directional or omni-directional.

A piston return spring 83 is disposed in the secondary cylinder 52 between piston 56 and nozzle assembly 72. The piston return spring 83 is a compression-type spring and alleviates the necessity of relying solely on friction to retract piston 56 and secondary cylinder 52 simultaneously. The piston return spring 83 forces piston 56 to retract within secondary cylinder 52 prior to retraction of the secondary cylinder 52 into the piston housing 26. The movement of the piston 56 prior to movement of the secondary cylinder 52 allows multiple pressure cycles to be performed without movement of the secondary cylinder 52. The multiple pressure cycles are performed with appropriately restricted handle movement.

To operate the device 10, the user depresses lever 36. Friction created by the piston seal 68 against the secondary cylinder 52 causes piston 56 and secondary cylinder 52 to substantially simultaneously move downwardly until the lowermost surface of the secondary cylinder 52 contacts the non-stain side of the garment 42 to be cleaned (FIG. 2). The stained side of the garment 42 is in physical contact with screen 22 on the upper surface 13 of base 12 (FIG. 1). The stained garment 42 is now "locked" between the secondary cylinder 52 and screen 22. Screen 22 stops further downward movement of secondary cylinder 52.

The piston 56 continues its downward movement within the secondary cylinder 52, forcing cleaning solution from pressure chamber 54. Cleaning solution exits pressure chamber 54 through outlet check valves 74 and into multiple nozzles 80 positioned at the lowermost surface of the nozzle assembly 72.

Threading on nozzle stem 70 and the interior of piston 56 forces nozzle assembly 72 to rotate as piston 56 moves downwardly thereover. Rotation of nozzle assembly 72 during operation of the device prevents the occurrence of multiple clean spots within the discolored portion of the garment being cleaned. Lever 36 and attachment means 58 connecting piston 56 thereto prevent rotation of piston 56 inside secondary cylinder 52 during the pressure/rotation cycle.

The lowermost surface of nozzle assembly 72 rotates freely within secondary cylinder 52. The O-rings 78 maintain an airtight seal between nozzle assembly 72 and secondary cylinder 52.

When lever 36 has reached the downward limit of its stroke, the secondary cylinder 52 and piston 56 are also in their most downward positions. A pressure/rotation cycle has now been completed.

The user releases lever 36. Friction created by piston seal 68 against secondary cylinder 52 combined with piston return spring 83 cause piston 56 and secondary cylinder 52 to retract upwardly to their original positions in the piston housing 26. Piston return spring 83 forces piston 56 to retract into secondary cylinder 52 prior to retraction of the secondary cylinder 52 into the piston housing 26. When secondary cylinder 52 has retracted fully into the piston housing 26, the secondary cylinder's 52 upward movement stops.

Piston 56 continues its upward movement into secondary cylinder 52, creating suction therein. The suction draws cleaning solution into the inlet check valves 66 in piston 56. This action refills the pressure chamber 54 in secondary cylinder 52 with cleaning solution for use during the next pressure/rotation cycle.

As illustrated more clearly in FIG. 4, a flexible transport tube 46 extends from the tube nipple 62 on piston 56 through the support member 24 (FIG. 4) of device 10 and downwardly into reservoir 44, thereby providing a constant source of cleaning fluid to the piston 56.

The device for removing stains from fabric of the present invention has numerous advantages over prior art cleaning devices. The present invention is cost-effective because it uses no electric or battery power during operation. The device is lightweight and portable and may be attached to any flat surface. The force exerted during the pressure/rotation cycle, coupled with the direct contact of the nozzles on the stain in the fabric, substantially increases the likelihood that the stain may be removed from the fabric. Multiple, rotating nozzles ensure that the stain is completely removed from the fabric. Pressure/rotation cycles may be repeated at the user's discretion, to ensure complete removal of the stain. Finally, the cleaning solution may be recycled, for additional cost and environmental benefits.

Although a preferred embodiment of the present invention has been illustrated in the accompanying Drawings and described in the foregoing Detailed Description, it will be understood that the invention is not limited to the embodiment disclosed, but is capable of numerous rearrangement, modifications, and substitutions of parts and elements without departing from the spirit of the invention.

I claim:

1. A device for removing stains from fabric using cleaning solution, comprising:
- a hollow base member having upper and lower surfaces, said base member including an opening in the upper surface thereof;
- a screen superimposed over the opening in the upper surface of the base member;
- a support member integrally mounted to the base member, said support member extending upwardly from the upper surface of said base member and having a first opening therein for receiving cleaning solution and a second opening therein for delivering cleaning solution to the stained fabric;
- a piston/nozzle assembly disposed within said support member, comprising:
  - a cylinder disposed within the support member, said cylinder capable of projecting from and retracting into the second opening of the support member and including a closed end and an open end;
  - a piston disposed within the cylinder capable of projecting from and retracting into the open end of the cylinder;
  - multiple nozzles for delivering cleaning solution to the stained fabric; and
  - attachment means connecting the nozzles to the piston;
- a lever fixably mounted to the support member; and
- means for transporting cleaning solution from the base member to the piston/nozzle assembly.

2. The device of claim 1 wherein the base member includes a viewing window.

3. The device of claim 1 further comprising attachment means for attaching the device to a flat surface.

4. The device of claim 3 wherein the attachment means comprises a plurality of suction cups.

5. The device of claim 1 further comprising a handle mounted to the support member.

6. The device of claim 1 further comprising a cap overlying the first opening in the support member.

7. The device of claim 1 wherein the support member terminates in a piston housing.

8. The device of claim 1 wherein the means for transporting cleaning solution from the base member to the piston/nozzle assembly comprises a flexible tube detachably mounted to the piston.

9. The device of claim 1 further comprising means for sealing the piston/nozzle assembly and the cylinder.

10. The device of claim 1 wherein the multiple nozzles rotatably deliver cleaning solution to the stained fabric.

11. A device for removing stains from fabric using cleaning solution, comprising:
- a substantially rectangular, hollow base member having upper and lower surfaces, and side and end panels, said base member having a substantially circular opening in the upper surface therein and a viewing window in one of the side panels thereof;
- multiple suction cups secured to the lower surface of the base member;
- a substantially circular screen superimposed over the opening in the upper surface of the base member;

a support member integrally mounted to the hollow base member, said support member extending upwardly from the upper surface of said base member and terminating in a piston housing having an opening therein, and including an opening in the upper surface therein for receiving cleaning solution;

a cap overlying the opening in the upper surface of the support member;

a piston/nozzle assembly disposed within the piston housing, comprising:

a cylinder disposed within the piston housing capable of projecting from and retracting into the opening of the piston housing and having a closed end and an open end;

a threaded piston disposed within the cylinder capable of projecting from and retracting into the open end of the cylinder, said piston including inlet check valves and a tube nipple for receiving cleaning solution from the hollow base member;

O-rings for sealing the piston and the cylinder;

a threaded nozzle stem having a first end and a second end, said first end connected to the piston;

a nozzle assembly disposed at the second end of the nozzle stem, comprising:

multiple nozzles capable of delivering pressurized cleaning solution to the stained fabric; and outlet check valves for receiving cleaning solution from the cylinder;

sealing means for sealing the nozzle assembly and the cylinder; and a spring disposed between the piston and the nozzle assembly;

a lever fixably mounted to the piston housing; and a flexible tube having a first end and a second end, the first end connected to the tube nipple on the piston and the second end terminating in the hollow base member, the second end including a screen thereover.

12. A piston/nozzle assembly mounted in a support member for applying pressurized cleaning solution to stained fabric, comprising:

a cylinder disposed within the support member;

a threaded piston disposed within the cylinder, said piston including means for receiving cleaning solution and means for delivering cleaning solution to the cylinder;

a threaded nozzle stem having a first end and a second end, the first end connected to the piston;

a nozzle assembly disposed at the second end of the nozzle stem, comprising:

multiple nozzles capable of delivering cleaning solution to the stained fabric; and means for receiving cleaning solution from the cylinder; and a spring disposed between the piston and the nozzle assembly.

13. The device of claim 12 wherein the means for receiving cleaning solution includes a tube nipple.

14. The device of claim 12 wherein the means for delivering cleaning solution to the cylinder includes inlet check valves.

15. The device of claim 12 wherein the means for receiving cleaning solution from the cylinder includes outlet check valves.

16. The device of claim 12 further comprising means for sealing the piston and cylinder.

17. The device of claim 12 further comprising means for sealing the nozzle assembly and the cylinder.

18. A piston/nozzle assembly mounted in a fixed piston housing for applying pressurized cleaning solution to stained fabric, comprising:

a cylinder disposed within the piston housing capable of projecting therefrom and retracting thereinto and having a closed and an open end;

a threaded piston disposed within the cylinder capable of projecting from and retracting into the open end of the cylinder, said piston including inlet check valves and a tube nipple;

sealing means for sealing the piston and the cylinder;

a threaded nozzle stem having a first end and a second end, the first end connected to the piston;

a nozzle assembly disposed at the second end of the nozzle stem, comprising:

multiple nozzles capable of delivering cleaning solution to the stained fabric; and outlet check valves for receiving cleaning solution from the cylinder; and O-rings for sealing the nozzle assembly and the cylinder; and a spring disposed between the piston and the nozzle assembly.

* * * * *